US011690449B2

(12) United States Patent
Zhu

(10) Patent No.: US 11,690,449 B2
(45) Date of Patent: Jul. 4, 2023

(54) CONVERTIBLE MULTI-FUNCTION FURNITURE

(71) Applicant: Shou Qiang Zhu, Ontario, CA (US)

(72) Inventor: Shou Qiang Zhu, Ontario, CA (US)

( * ) Notice: Subject to any disclaimer, the term of this patent is extended or adjusted under 35 U.S.C. 154(b) by 0 days.

(21) Appl. No.: 17/235,886

(22) Filed: Apr. 20, 2021

(65) Prior Publication Data

US 2022/0151380 A1 May 19, 2022

Related U.S. Application Data

(60) Provisional application No. 63/113,909, filed on Nov. 15, 2020.

(51) Int. Cl.

| | |
|---|---|
| ***A47B 85/06*** | (2006.01) |
| ***A47B 43/00*** | (2006.01) |
| ***A47B 3/02*** | (2006.01) |

(52) U.S. Cl.

CPC ..... *A47B 85/06* (2013.01); *A47B 3/02* (2013.01); *A47B 43/00* (2013.01); *A47B 2003/025* (2013.01)

(58) Field of Classification Search

CPC ..... A47B 3/02; A47B 2003/025; A47B 85/06; A47B 43/00

USPC ..... 312/408

See application file for complete search history.

(56) References Cited

U.S. PATENT DOCUMENTS

| | | | | |
|---|---|---|---|---|
| 2,601,357 A * | 6/1952 | Allbritton | A47B 3/02 108/118 |
| 2011/0174012 A1* | 7/2011 | Park | F25D 25/02 62/449 |
| 2014/0055017 A1* | 2/2014 | McMillin | A47B 96/06 211/134 |

FOREIGN PATENT DOCUMENTS

| | | | |
|---|---|---|---|
| CN | 108606468 A * | 10/2018 | |
| CN | 108634642 A * | 10/2018 | A47B 31/04 |
| CN | 108926145 A * | 12/2018 | |
| CN | 109222456 A * | 1/2019 | A47B 85/06 |
| CN | 109431072 A * | 3/2019 | A47B 13/081 |
| GB | 2102277 A * | 2/1983 | A47B 5/06 |
| WO | WO-2020019032 A1 * | 1/2020 | A47B 3/0818 |

* cited by examiner

*Primary Examiner* — Matthew W Ing

(74) *Attorney, Agent, or Firm* — Che-Yang Chen; Law Office of Michael Chen

(57) ABSTRACT

A multi-function furniture includes: pairs of support frames, each of the support frames having a top end and a bottom end; a plurality of retaining pieces pivotally connected to the top ends of the support frames; pairs of parallel side frames, each of the parallel side frames pivotally connected to the retaining pieces; a series of angular frames, each of the angular frames having a distal end and a proximal end, the distal ends and the proximal ends being pivotally connected to the parallel side frames; wherein one of the pair of the support frames is pivotally connected with the other one of the pair the support frame.

19 Claims, 6 Drawing Sheets

CONVERTIBLE MULTI-FUNCTION FURNITURE

FIELD OF THE DISCLOSURE

The present disclosure relates to a convertible multi-function furniture, and more particularly to a multifunction furniture enable to operate between a vertical configuration which may be employed as a shelf, a horizontal configuration which may be employed as a table, and a collapsed configuration which may be easy for transportation.

BACKGROUND OF THE DISCLOSURE

Generally, a multifunction furniture has been widely developed in the furniture industry. In particular, shelves and tables are two of the most popular furniture. The size of living spaces can be smaller and smaller in urban areas these days. Therefore, building smaller or collapsed furniture is only a way of solutions. However, the designing furniture articles which serves multifunction is more effective way to utilize precious living space in homes.

The multi-function conversion table which can be turned into a table or a shelf has been developed in the current market, but one non-limiting example of the problems associated with multifunction table is that in order to hold the furniture article either as a table or a desk, a complicity lock assembly should be employed. Specifically, the lock assembly may utilize cords or embedded locking mechanism which may increase the manufacturing cost or the total weight of the furniture article. Conventionally, an adjustable hand-wheel could be employed as the locking mechanism; however, the user needs to overcome the weight of the shelves in order to tightly lock the furniture in desired positions.

To overcome this known problem, past solutions have involved using locking pins to lock the shelves. However, when the furniture is performed as a shelf, the locking pins could not stably hold the furniture in positions. The locking pins could always be employed at a middle portion of the shelf or table, but two ends of the shelf or table are still suspended above the surface. Therefore, in this manner, the body or side frames of the furniture may shake or even collapse by the external force. In addition, even if the lock mechanism is easy to operate, the locking mechanism might be seized up or stopped through the daily use. The locking mechanism may need to be replaced or sent back to the manufacturers.

As mentioned in the foregoing description, for holding the furniture in desired position, there is a continuing need for new ways to hold the convertible multifunction furniture in the desired position through a simply locking mechanism without increasing the manufacture cost, and also maintain the security during the uses of the furniture in either performing as the shelf or as the table.

BRIEF SUMMARY OF THE DISCLOSURE

In a general implementation, a multi-function furniture that is convertible between a vertical, horizontal, and collapsed configurations, the furniture comprising: pairs of support frames, each of the support frames having a top end and a bottom end; a plurality of retaining pieces pivotally connected to the top ends of the support frames; pairs of parallel side frames, each of the parallel side frames pivotally connected to the retaining pieces; a series of angular frames, each of the angular frames having a distal end and a proximal end, the distal ends and each of the proximal end being pivotally connected to the parallel side frames; wherein one of the pair of the support frames is pivotally connected with the other one of the pair the support frame.

In another aspect combinable with the general implementation, a series of pins arranged on one of the pair of the parallel side frames and a series of first hook rotatably arranged on the other one of the pair of the parallel side frames and configured to hook on the pins.

In another aspect combinable with the general implementation, a series of pins arranged on one of the pair of the parallel side frames and a series of second hook rotatably arranged on the support frames and configured to hook on the pins.

In another aspect combinable with the general implementation, the pairs of the support frames support the angular frames vertically arranged relative to the parallel side frames such that the furniture is at the vertical configuration.

In another aspect combinable with the general implementation, the pairs of the support frames support one of the angular frames being in alignment with one another such that the furniture is at the horizontal configuration.

In another aspect combinable with the general implementation, the pairs of support frames are folded to parallelly arranged relative to the angular frames and the parallel side frames, wherein each one of the angular frames in alignment with one another such that the furniture is at the collapsed configuration.

In another aspect combinable with the general implementation, one of the pair of support frames is pivotally connected to the other one of the pair of the support frame at an acute angle or obtuse angle.

In another aspect combinable with the general implementation, one each of the retaining pieces comprises an inner surface and an outer surface formed at an opposite side of the inner surface, wherein the top end of one of the pair of the support frames is pivotally connected to the inner surface and the top end of the other one of the pair of the support frames is pivotally connected to the outer surface.

In another aspect combinable with the general implementation, wherein the bottom end of the support frame is formed at an opposite end of the top end, wherein the bottom end is configurated to biased against a surface.

In another aspect combinable with the general implementation, a series of second hook rotatably arranged on the support frames and near the bottom ends of the support frames, wherein the second hooks are configured to hook on the pins.

In another aspect combinable with the general implementation, a series of pins formed one of the pair of the parallel side frames, and a series of first hooks rotatably arranged on the other one of the pair of the parallel side frames and configured to hook on the pins.

In another aspect combinable with the general implementation, each of the side frames comprises an intermediate end being pivotally connected to the retaining pieces, wherein the intermediate end bisects the side frame.

In another aspect combinable with the general implementation, the distal end of the angular frame is pivotally connected to one of the pair of the parallel side frame, and the proximal end of the angular frame is pivotally connected to the other one of the pair of the parallel side frame.

In another aspect combinable with the general implementation, a series of pins formed on one of the pair of the parallel side frames and a series of first hooks rotatably arranged on the other one of the pair of the parallel side frames and configured to hook on the pins, wherein the first hooks are above the level of the pins and the parallel side frames are vertically arranged relative to the angular frames.

In another aspect combinable with the general implementation, the series of angular frames comprises pairs of first angular frames and second angular frames, wherein the first angular frame is parallelly arranged relative to the second angular frame.

In another aspect combinable with the general implementation, a series of cross frames affixed with the first angular frame and the second angular frame, wherein each of the cross frames is parallelly arranged with one another.

In another aspect combinable with the general implementation, the retaining pieces are pivotally connected to the top ends of the support frames to form first pivots, and the parallel side frames are pivotally connected to the retaining pieces to form the second pivots, wherein the second pivots are above the level of the first pivots.

In another aspect combinable with the general implementation, a plurality of shelves being secured on the angular frames and cross frames vertically arranged and affixed with pairs of angular frames.

In another aspect combinable with the general implementation, the second hooks are inclinedly arranged to hook on the pins at an acute angle or an obtuse angle with respect to the support frame.

In another aspect combinable with the general implementation, the first hooks are normal to the support frames.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

Figure 1:
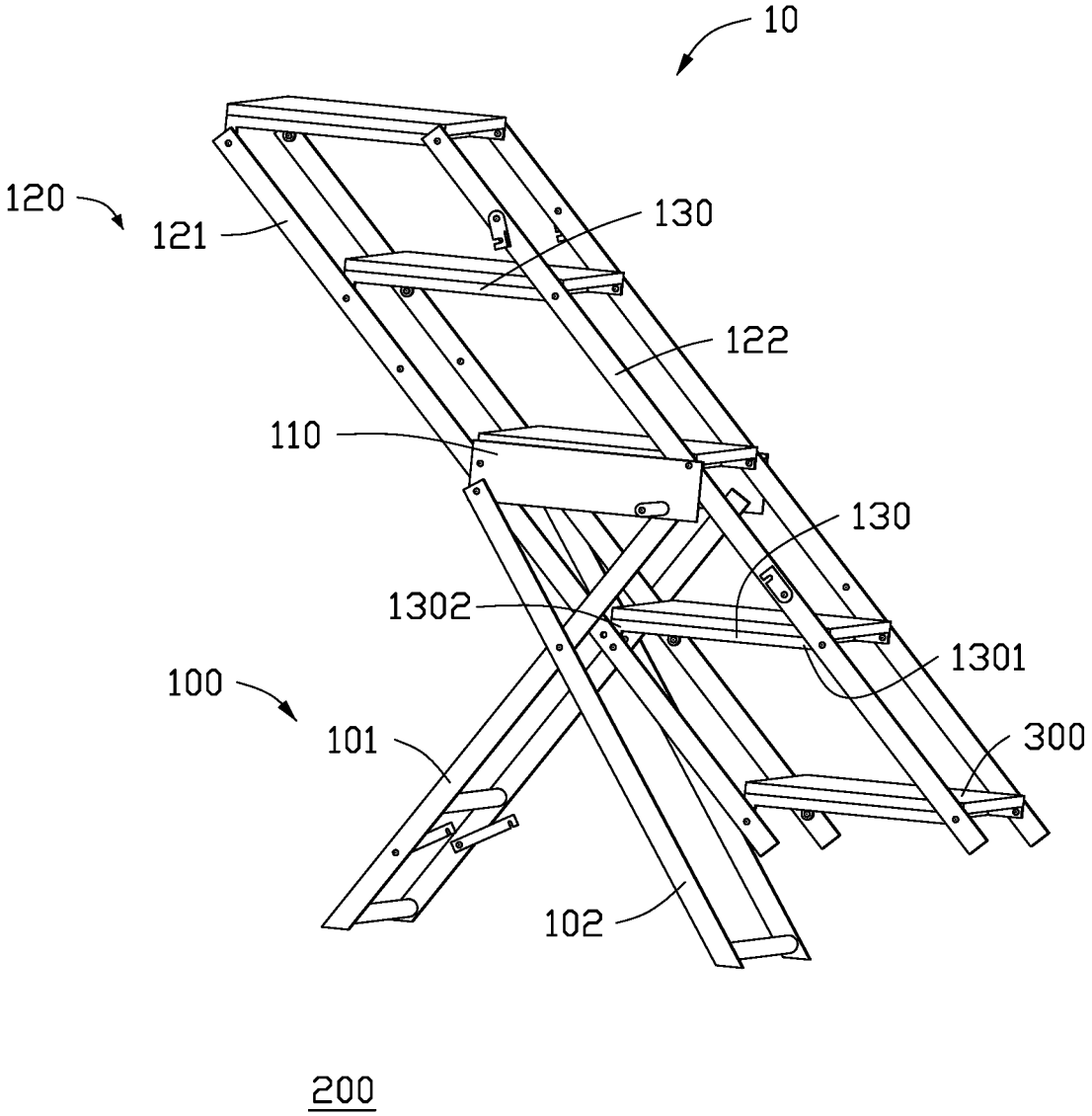
FIG. 1 is a side view of an embodiment of a convertible multi-function furniture according to an aspect of the embodiment.

FIG. 1 generally depicts a side view of a convertible multi-function furniture 10 in accordance with the one of the disclosed embodiments.

The multi-function furniture 10 that is convertible between a vertical, horizontal, and collapsed configurations, wherein the furniture 10 comprises pairs of support frames 100, wherein each of the support frames 100 comprises a top end and a bottom end configured to support on a surface 200, and a plurality of retaining pieces 110 where the top ends of the support frames 100 may be pivotally connected thereto. Each pair of the support frames 100 comprises a first support frame 101 and a second support frame 102 pivotally connected with the first support frame 101, wherein the first support frame 101 may be intersected with the second support frame 102 at a pivotal point. Preferably, the pivotal point may be formed near the top ends of the support frames. Preferably, the pivotal point may be formed at the one fourth near the top ends of support frames 100.

Figure 2:
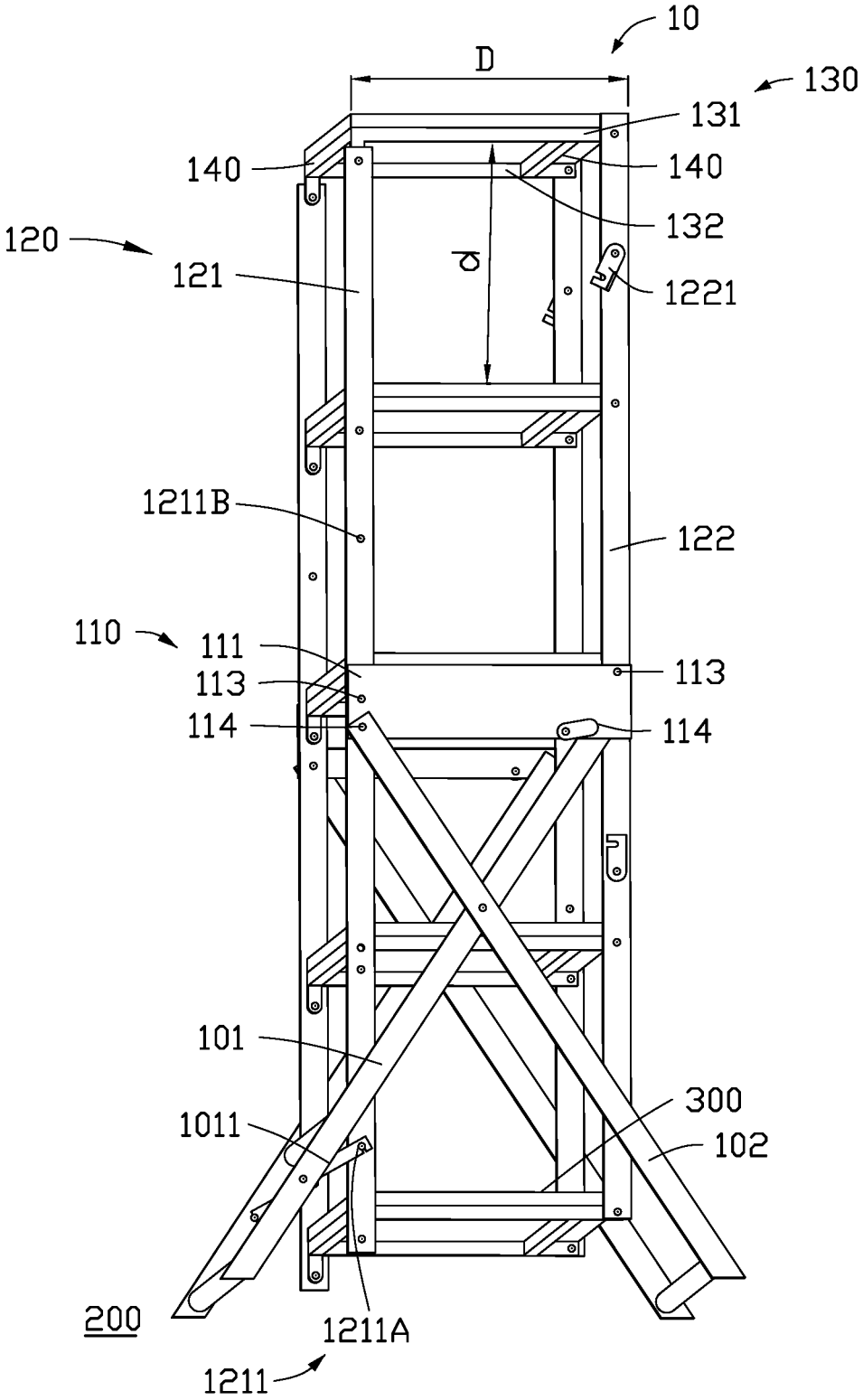
FIG. 2 is a side view of the embodiment of the convertible multi-function furniture according to the aspect of the embodiment, showing that the furniture is at the vertical configuration.

As shown further in FIGS. 1-2, the multi-function furniture 10 further comprises pairs of parallelly-arranged side frames 120, including a first side frame 121 parallelly arranged with a second side frame 122, wherein each of the parallel side frames 120 having a first top end, a first bottom end, and an intermediate end to be pivotally connected to the retaining pieces 110. The multi-function furniture 10 further comprises a series of angular frames 130, wherein each of the angular frames comprises a distal end 1301 and a proximal end 1302, and each of the distal ends 1301 and each of the proximal ends 1302 being pivotally connected to the parallel side frames 120.

In some embodiments, the angular frames 130 further comprises a plurality of first angular frames 131 and a plurality of second angular frames 132 parallelly arranged relative to the first angular frames 131, wherein the distal end and the proximal end of the first angular frames 131 may be pivotally and/or rotatably connected to one pair of the parallelly-arranged side frames 120, and the distal end and the proximal end of the second angular frames 132 may be pivotally and/or rotatably connected to another pair of the parallelly-arranged side frames 120.

In another embodiments, the multi-function furniture 10 further comprises a locking assembly configured to lock the furniture 10 in the vertical configuration, the horizontal configuration, and the collapsed configuration, wherein the locking assembly comprises a plurality of hooks and a plurality of pins, wherein each of the hooks defines a notch to be engaged with one of the pins so as to lock the furniture in positions.

Figure 3:
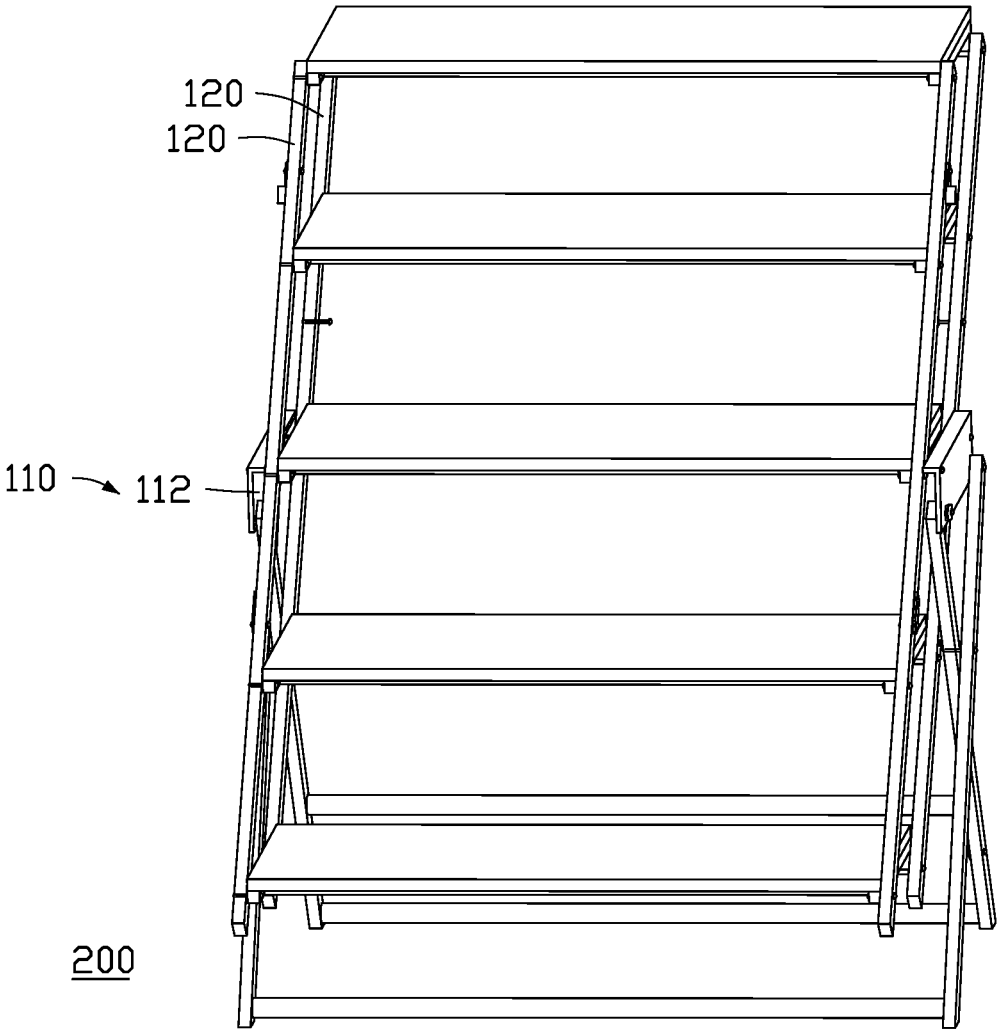
FIG. 3 is a front view of the embodiment of the convertible multi-function furniture according to the aspect of the embodiment, showing that the furniture is at the vertical configuration.

Referring now to the details of FIGS. 1-3, the retaining pieces 110 are thin and flat plates, wherein the retaining pieces 110 are formed in pairs, and one of the pair of the retaining pieces 110 may by symmetrically arranged with the other one of the pair of the retaining pieces 110. Each of the retaining pieces 110 comprises an inner surface 112 and an outer surface 111 formed at an opposite side of the inner surface 112, wherein the top end of one of the pair of the support frames or the first support frame 101 may be pivotally connected to the inner surface 112 and the top end of the other one of the pair of the support frames or the second support frame 102 may be pivotally connected to the outer surface 111. In one aspect, the side frames 120 may be pivotally connected to the inner surface 112 of the retaining pieces 110. In other words, the first support frame 101 and the second support frame 102 may be pivotally and/or rotatably arranged on the two opposite sides of one retaining piece 110.

In some embodiments, the side frames 120 may be pivotally connected with the retaining pieces 110 at first pivots 113 and the top ends of the support frames 100 may be pivotally connected to the retaining pieces 111 at second pivots 114, wherein the first pivots 113 may be above the level of the second pivots 114.

Turning now to FIG. 2, in another embodiment, the multi-function furniture 10 further comprises a series of pins 1211 arranged on the first side frame 121 or one of the pair of the parallelly-arranged side frames and a series of first hooks 1221 pivotally and rotatably arranged on the second side frame 122 or other one of the pair of the parallel side frames, wherein the first hooks 1221 may not be engaged with the pins 1211 of the first side frames 121 and the furniture may be at the vertical configuration.

Continuing to FIG. 2, in another embodiment, the multi-function furniture 10 further comprises a series of pins 1211 arranged on the pairs of the parallel side frames 120 and a series of second hook 1011 pivotally and rotatably arranged on the support frames 100, wherein the second hook 1011 could be pivotally rotated and the notches formed thereon may be engaged with the pins 1211 on the pair of the parallelly-arranged side frames 120. The second hook 1011 may be inclinedly arranged with respect to the support frame 100 at an acute angle or an obtuse angle and the notches formed thereon may be engaged with the pins 1211 on the parallelly-arranged side frames 120, such that the parallelly-arranged side frames 120 may be held to spacedly arrange in a distance defining by a length "D" of the angular frame 130. In one aspect, the one of the pair of the parallelly-arranged side frames 120 or the first side frame 121 which has the pins 1211 arranged thereon has no hooks arranged thereon.

FIGS. 2-3 generally depict the basic architecture of the multi-function furniture 10 at the vertical configuration, wherein the pairs of the support frames 100 support the angular frames 130 being vertically arranged relative to the parallel side frames 120. The pairs of the parallel side frames 120 may be pivotally rotated with respect to the retaining pieces 110 and be vertically arranged with respect to the surface 200, wherein the angular frames 130 may be pivotally operated with respect to the side frames 120 and be vertically arranged with respect to the side frames 120, and the support frames 100 may be unfolded with the first support frame 101 being intersected with the second support frame 102 to form an acute angle or obtuse angle. In this manner, the bottom ends of the support frames 100 may be biased against the surface 200 to support the angular frames 130 being suspended above the surface 200, and the second hook 1011 may be pivotally rotated to be inclinedly arranged with respect to the support frame 100 to form acute angle or obtuse angle with notches formed thereon being engaged with the pins 1211 arranged near the first bottom ends of the side frames 120.

In another aspect, as shown in FIGS. 2-3, the pins 1211 arranged on one of the pair of the parallelly-arranged side frames or the first side frame 121 comprises a lower pin 1211A near the first bottom end of the first side frame 121, wherein the lower pin 1211A may be selectively engaged with the second hook 1011 and the multi-function furniture 10 may be held at the vertical configuration. In this way, the first hooks 1221 may not be engaged with any of the pins 1211 arranged on the parallelly-arranged side frame 120.

Figure 4:
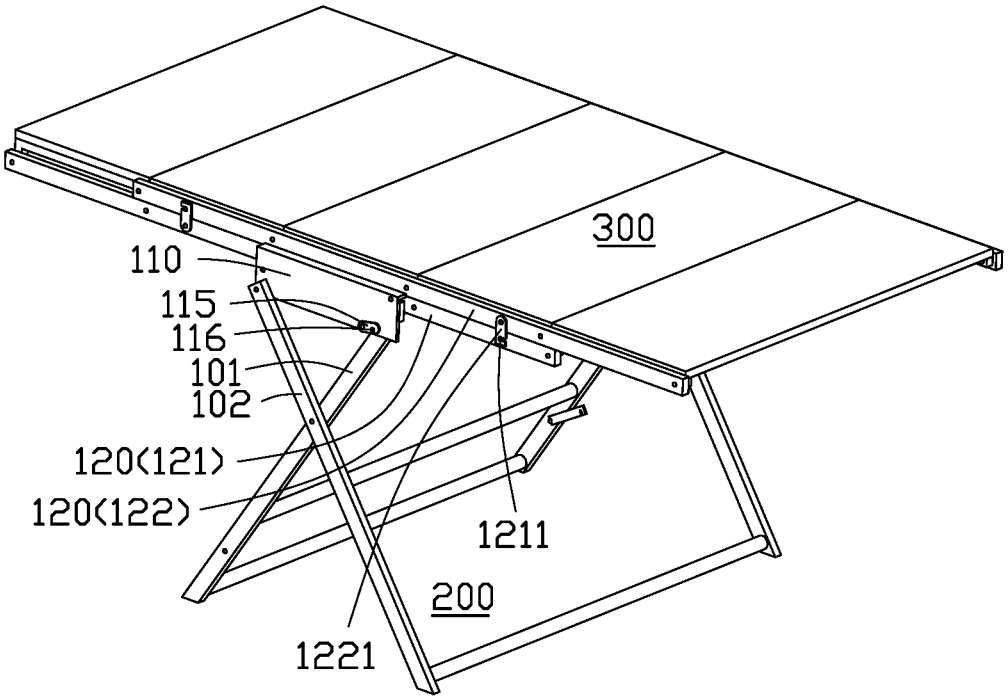
FIG. 4 is a sectional view of an embodiment of the convertible multi-function furniture to the aspect of the embodiment, showing that the furniture is at the horizontal configuration.

Continuing to FIG. 4, the multi-function furniture 10 further comprises a series of third hooks 115 pivotally and rotatably arranged on the retaining pieces 110. The third hooks 115 may be pivotally rotated with respect to the retaining pieces 110, wherein the top ends of the support frames 100 may be pivotally rotated with respect to the retaining pieces 110 through retaining pins 116. The retaining pins 116 may be passed through the retaining pieces 110. In this way, the third hooks 115 may be pivotally rotated with the notches formed thereon being engaged with the retaining pins 116, such that the support frames 100 may be locked in positions. In other words, the first support frame 101 may be held to intersect with the second support frame 102 to form an acute angle or an obtuse angle.

As shown further in FIGS. 2-3, each of the side frames 120 may further comprises a first inner surface and a first outer surface pivotally and/or rotatably connected with the retaining pieces 110, wherein the distal ends 1301 and the proximal ends 1302 of the angular frames 130 may be pivotally and rotatably connected to the inner surface of the side frames 120. The multi-function furniture 10 further comprises a series of cross frames 140, wherein the cross frame 140 has a proximal end affixed with the first angular frame 131 and a distal end affixed with the second angular frame 132, wherein each of the cross frames 140 may be parallelly arranged with one another. The cross frame 140 may be configurated to connect the first angular frame 131 and the second angular frame 132, wherein the cross frame 140 may support the first angular frame 131 and the second angular frame 132 being operated simultaneously. The cross frame 140 may be vertically arranged with respect to the angular frames 130, including the first angular frame 131 and the second angular frame 132.

Figure 5:
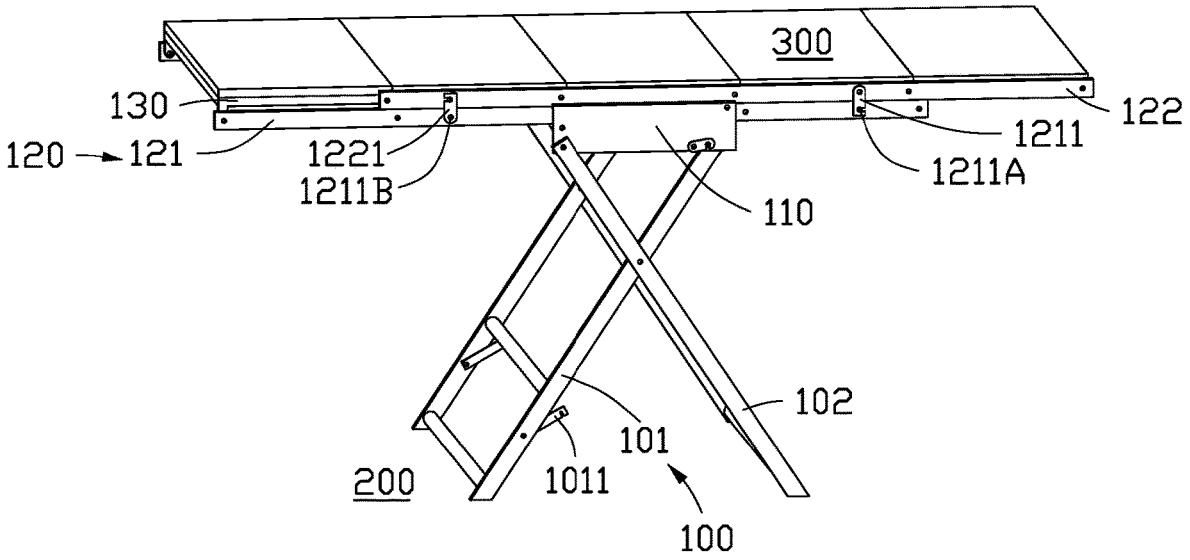
FIG. 5 is a front view of the embodiment of FIG. 4, showing that the furniture is at the horizontal configuration.

FIGS. 4 and 5 generally depict the basic architecture of the multi-function furniture 10 at the horizontal configuration, wherein the pairs of the support frames 100 support each one of the angular frames 130 in alignment with one another. The side frames 120 may be pivotally rotated with respect to the retaining pieces 110 and the side frames 120 may be parallelly arranged relative to the surface 200. In the other words, the side frames 120 may be parallelly arranged relative to the retaining pieces 110, wherein the first side frame 121 may be stacked on the second side frame 122. In this manner, the bottom ends of the support frames 100 may be biased against the surface 200, and the first hooks 1221 may be pivotally rotated to be vertically arranged with respect to the side frames 120 with notches formed thereon being engaged with the pins 1211 arranged on the side frames, such that the side frames 120 in pair, including the first side frame 121 and the second side frame 122, may be locked or held to be stacked with each other.

In still another aspect, as shown in FIGS. 4-5, the pins 1211 arranged on one of the pair of the parallelly-arranged side frames 120 or the first side frame 121 further comprises a higher pin 1211B near the first top end of the first side frame 121. The higher pin 1211B and the lower pin 1211A may be selectively engaged with the first hooks 1221 and the multi-function furniture 10 is at the horizontal configuration, and the third hooks 115 may be selectively engaged with the retaining pins 116 passed through the retaining pieces 110, and second hooks 1011 may not be engaged with any of the pins 1211 arranged on the parallelly-arranged side frames 120.

In still another embodiments, as shown FIGS. 1-6, the distal end and the proximal end of the angular frames 130, including the first angular frame 131 and the second angular frame 132, may be pivotally operated with respect to the side frames 120, wherein the angular frames 130 may be either vertically arranged relative to the side frames 120 or parallelly-arranged relative to the side frames 120. In one aspect, the first angular frame 131 and the second angular frame 132 may be simultaneously and pivotally operated with respect to the side frames 120. In other words, the distal end of the first angular frame 131 may be pivotally operated relative to the first side frame 121 or one of the pair of the parallel side frames 120, and the proximal end 1302 of the first angular frame 131 may be pivotally operated relative to the second side frame 122 or the other one of the pair of the parallel side frames 120.

Figure 6:
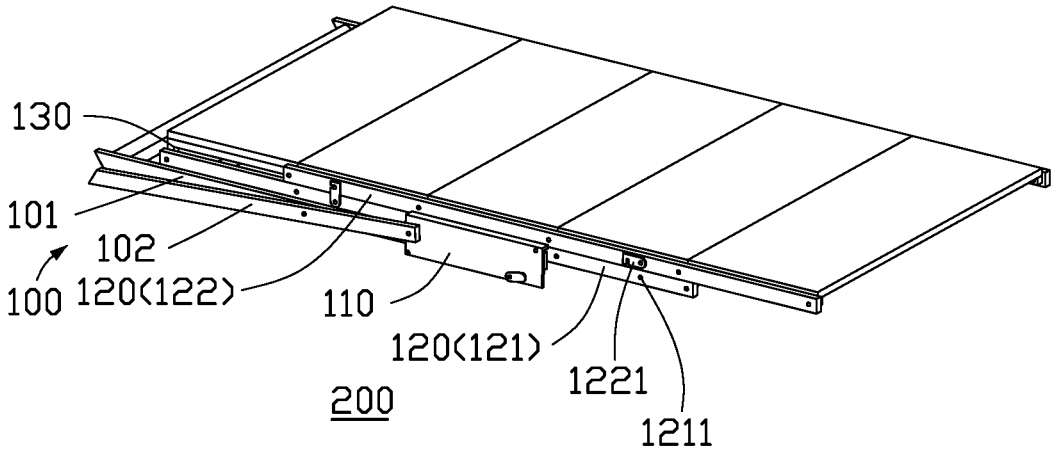
FIG. 6 is a side view of the embodiment of the convertible multi-function furniture to the aspect of the embodiment, showing the furniture is at the collapsed configuration.

Continuing to FIG. 6, each one of the pairs of support frames 100 may be folded to parallelly arranged with respect to the angular frames 130 and the parallel side frames 120, including the first side frame 121 and the second side frame 122, wherein each of the angular frames 130 may be pivotally operated relative to the retaining pieces 110 and in alignment with one another such that the furniture is at the collapsed configuration. In this way, the side frames 120 may be pivotally operated with respect to the retaining pieces 110 and the side frames 120 may be parallelly arranged with respect to the surface 200. In the other words, the side frames 120 may be parallelly arranged relative to the retaining pieces 110.

Referring to FIGS. 5-6, the first hooks 1221 could be arranged near the first bottom end and/or near the first top end of one of the pair of the side frames 120 or the second side frame 122 and the first hooks 1221 may be engaged with the pins 1211 arranged on another one of the pair of the side frames 120 or the first side frame 121, and in this manner, the parallelly-arranged side frames 120, including the first side frame 121 and the second side frame 122, may be tightly locked with each other, such that the side frames 120, including the first side frame 121 and the second side frame 122, may not shake or sway by the external force.

Referring to FIGS. 1-5, the third hooks 115 may be configured to lock the first support frame 101 and the second support frame 102 in positions. In other words, the third hooks 115 being engaged with the retaining pins 116 arranged passed through the retaining pieces 110 may be employed to hold the first support frame 101 and the second support frame 102 being unfolded, wherein the first support frame 101 and the second support frame 102 may be intersected to form an acute angle or obtuse angle. In this manner, the third hooks 115 may be pivotally rotated to be parallelly arranged with respect to the retaining pieces 110. In other words, the third hooks 115 may be pivotally rotated to be parallelly arranged with respect to the surface 200.

Referring to FIGS. 1-6, according to all of the embodiments described herein, the multi-function furniture 10 further comprises a plurality of shelves 300 being secured on the angular frames 130 and the cross frames 140, wherein each one of the shelves 300 may be supported on the first angular frame 131, the second angular frame 132, and the cross frames 140.

According to all of the embodiments described herein, each of the angular frames 130 may be spacedly and parallelly arranged with one another in a distance "d", wherein a length of the angular frame 130 could be defined as "D". The distance "d" may be longer than the length "D" of the angular frame 130, and the angular frames 130 may have enough space to be operated either to be normal to or to be parallel to the side frames 120.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

Thus, specific embodiments and applications of the convertible multi-function furniture have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A multi-function furniture, comprising:

pairs of support frames, each of the support frames having a top end and a bottom end;

a plurality of retaining pieces pivotally connected to the top ends of the support frames;

pairs of parallel side frames, each of the parallel side frames pivotally connected to the retaining pieces;

a series of angular frames, each of the angular frames having a distal end and a proximal end, each of the distal ends and the proximal end being pivotally connected to the parallel side frames; and a series of pins arranged on one of the pair of the parallel side frames and a series of second hooks rotatably arranged on the support frames and configured to engage with the pins, wherein one of the pair of the support frames is pivotally connected with the other one of the pair the support frames.

2. The furniture of claim 1, wherein the furniture is convertible between desired configurations, including a vertical, horizontal, and collapsed configurations.

3. The furniture of claim 2, wherein the pairs of the support frames support the angular frames being vertically arranged relative to the parallel side frames such that the furniture is at the vertical configuration.

4. The furniture of claim 3, wherein said series of second hooks are located near the bottom ends of the support frames, and are configured to engage with corresponding pins.

5. The furniture of claim 4, wherein the second hooks are inclinedly arranged to engage with the pins at an acute angle or an obtuse angle with respect to the support frames.

6. The furniture of claim 2, wherein the pairs of the support frames support each one of the angular frames being in alignment with one another such that the furniture is at the horizontal configuration.

7. The furniture of claim 6, further comprising a series of pins formed one of the pair of the parallel side frames, and a series of first hooks rotatably arranged on the other one of the pair of the parallel side frames and the first hooks configured to engage with the pins.

8. The furniture of claim 7, wherein the first hooks are normal to the support frames.

9. The furniture of claim 2, wherein the pairs of support frames are capable of being folded to be parallelly arranged relative to the angular frames and the parallel side frames, wherein each one of the angular frames in alignment with one another such that the furniture is at the collapsed configuration.

10. The furniture of claim 1, further comprising a series of pins arranged on one of the pair of the parallel side frames, and a series of first hook rotatably arranged on the other one of the pair of the parallel side frames and configured to engage with the pins.

11. The furniture of claim 1, wherein one of the pair of support frames is pivotally connected to the other one of the pair of the support frame at an acute angle or an obtuse angle.

12. The furniture of claim 1, wherein each of the retaining pieces comprises an inner surface and an outer surface formed at an opposite side of the inner surface, wherein the top end of one of the pair of the support frames is pivotally connected to the inner surface and the top end of the other one of the pair of the support frames is pivotally connected to the outer surface.

13. The furniture of claim 1, wherein the retaining pieces are formed in at least one pair and each one of the pair of the retaining pieces is symmetrically arranged with respect to the other one of the pair of the retaining pieces.

14. The furniture of claim 1, wherein the distal end of the angular frame is pivotally connected to one of the pair of the parallel side frame, and the proximal end of the angular frame is pivotally connected to the other one of the pair of the parallel side frame.

15. The furniture of claim 1, further comprising a series of pins formed on one of the pair of the parallel side frames and a series of first hooks rotatably arranged on the other one of the pair of the parallel side frames and configured to engage with the pins, wherein the first hooks are above the level of the pins and the parallel side frames are vertically arranged relative to the angular frames.

16. The furniture of claim 1, wherein the angular frames comprises pairs of first angular frames and second angular frames, wherein the first angular frame is parallelly arranged relative to the second angular frame.

17. The furniture of claim 16, further comprising a series of cross frames affixed with the first angular frame and the second angular frame, wherein each one of the cross frames is parallelly arranged with one another.

18. The furniture of claim 1, wherein the retaining pieces are pivotally connected to the top ends of the support frames to form first pivots, and the parallel side frames are pivotally connected to the retaining pieces to form the second pivots, wherein the second pivots are above the level of the first pivots.

19. The furniture of claim 1, further comprising a plurality of shelves being secured on the angular frames and cross frames vertically arranged and affixed with pairs of angular frames.

* * * * *